US005904384A

United States Patent [19]

Mader et al.

[11] Patent Number: 5,904,384

[45] **Date of Patent: *May 18, 1999**

[54] PUSH PAD TRIGGER RELEASE EXIT DEVICE WITH INFINITE DEADLOCKING

[75] Inventors: Gerald E. Mader; William P. Dye; Matthew S. Prucinsky, all of Indianapolis, Ind.

[73] Assignee: Von Duprin, Inc., Indianapolis, Ind.

[ * ] Notice: This patent is subject to a terminal disclaimer.

[21] Appl. No.: 08/903,972

[22] Filed: Jul. 31, 1997

Related U.S. Application Data

[60] Continuation of application No. 08/726,122, Oct. 4, 1996, Pat. No. 5,673,949, which is a division of application No. 08/578,770, Dec. 26, 1995, Pat. No. 5,609,371.

[51] Int. Cl.[6] ..... E05B 63/20

[52] U.S. Cl. ..... 292/333; 292/164

[58] Field of Search ..... 292/164, 168, 292/341.13, 63, 65, 67, 68, 92, 146, 147, 163, 169.13, 333–336

[56] References Cited

U.S. PATENT DOCUMENTS

| | | | |
|---|---|---|---|
| 695,642 | 3/1902 | Hearn . | |
| 2,558,509 | 6/1951 | Cerf . | |
| 3,214,947 | 11/1965 | Wikkerink . | |
| 3,970,339 | 7/1976 | Haselton | 292/108 |
| 4,161,804 | 7/1979 | D'Hooge | 16/48.5 |

*Primary Examiner*—Steven Meyers
*Assistant Examiner*—Gary Estremsky
*Attorney, Agent, or Firm*—Michael H. Minns; Robert F. Palermo

[57] ABSTRACT

A push pad releasable exit device with continuous deadlocking for mounting near a door edge for engaging a lock strike includes a housing having first and second sidewalls upon which are mounted two end walls and an internal wall parallel to the end walls, each of the end walls and the internal wall having a hole, the holes being aligned on a common axis, the first sidewall having a wedge stop projecting inwardly therefrom toward the axis of the holes in the end walls and the internal wall; a tapered latch bolt mounted on a cylindrical shaft the shaft extending through the holes and having a provision for urging the latch bolt toward the lock strike; a wedge plate having a hole providing clearance around the shaft and aligned with the holes in the end walls, having a tab pivotally resting in a slot of the second wall, and having a corner distal from the tab resting against the wedge stop when the door is in an open position; a provision for sensing when the door is in a closed position and for flipping the wedge plate away from the wedge stop to grip the shaft and to thereby deadlock the latch bolt; and further provision for releasing the shaft in response to minimal deflection of the push pad to permit the latch bolt to ride over the lock strike driven only by the normal force required to open the door.

13 Claims, 5 Drawing Sheets

PUSH PAD TRIGGER RELEASE EXIT DEVICE WITH INFINITE DEADLOCKING

This is a continuation of application Ser. No. 08/726,122 field Oct. 4, 1996, now U.S. Pat. No. 5,673,949 which is a division of Ser. No. 08/578,770 field Dec. 26, 1995 which issued as U.S. Pat. No. 5,609,371 on Mar. 11, 1997.

BACKGROUND OF THE INVENTION

This invention relates generally to push pad operated exit devices and more particularly to exit devices having push pads requiring minimal motion for unlatching a door.

There are basically two types of push pad exit devices used to secure the entrance of a building, namely rim lock and vertical rod lock. The rim lock latches the door on the door edge opposite the hinge edge by means of a latch bolt which projects into a strike pocket located in the vertical door frame member. The vertical rod latches the door, on the same door edge as does the rim lock, with two latches, one projecting into a strike in the top horizontal portion of the door frame and the other projecting down into a floor mounted strike. The purpose of the rim lock and vertical rod lock is to secure an entrance, such that attempts to open the door from the inside of the building without pushing on the push pad or outside of the building using the door trim will fail.

In the rim latching application, the latch bolt is rotatable about a fixed axle. As the door is shut, the latch bolt rotates to bump over a fixed strike on the door frame. After clearing the strike, the latch bolt projects into the strike pocket. The latch bolt, being spring biased into the strike, locks the door to the frame.

Additional security and tamper resistance is provided by means of a deadlocking feature which, when activated, prevents the latch bolt from being retracted without the use of the push pad or trim. An auxiliary bolt, which is triggered by the closing of the door, enables the deadlocking feature when the auxiliary bolt is pressed into the door by the proximity of the door edge to the door strike. Deadlocking, which is maintained as long as the door remains closed, results from movement of a component within the push pad device which allows a blocking member to drop by gravity into a position to prevent the latch bolt from being externally manipulated or forced out of the strike to open the door When the push pad is depressed, the auxiliary bolt is disengaged along with the deadlocking feature, and the latch bolt is physically retracted out of the strike pocket to open the door.

In vertical rod latching, a push pad on the inside of the door retracts the vertical latch bolts out of the strikes when pushed. The latches are normally spring biased into the strikes located in the floor and header of the frame. The vertical rod design requires some mechanism for keeping the latch bolts retracted inside the door once the door is open and the push pad is released since, while the push pad is depressed, both latch bolts are held in their retracted states. However, upon release of the push pad, the door begins to close, and the bottom latch drags on the floor. To prevent this drag, the top latch has a feature inside which keeps the latch bolts in the retracted position until the door closes. The top latch bolt is set in the retracted position by depressing the push pad, and the bottom latch bolt is physically connected to the top latch bolt by a series of linkages. The bottom latch bolt is held retracted by means of the linkages and the mechanism in the top latch responsible for setting the top latch bolt in the retracted position. A pin in the frame door stop depresses a trigger in the top latch as the door closes releasing the latch bolts into the strikes to lock the door.

Deadlocking, in the vertical rod applications, is accomplished by means of complicated timing of lever arms to block the latch bolts from external manipulation. These blocking mechanisms are, at best, capable of one to three latch bolt stopping positions. A latch in a vertical rod application incorporates a blocking member to prevent the latch bolt from being retracted by external means without the use of the push pad. When the door is closed, the extended position of the latch bolt allows a spring biased lever inside the latch to move into a position capable of blocking the latch bolt. This spring biased lever can have one to three steps which allow blocking of the latch bolt at three different extensions thereof. These different extensions of the latch bolt are required to account for the varied bottom door gaps encountered in the field. The push pads when depressed, moves the blocking lever out of the path of the latch bolt to allow withdrawal of the latch bolt and opening of the door.

Both the rim latching and the vertical rod latching systems have disadvantages, namely, the gravity drop deadlocking design of the rim latching system is very sensitive to manufacturing tolerances and is prone to unreliability and field failures if not diligently monitored by the manufacturer. In the vertical rod system, the top latch is used to hold itself and the bottom latch retracted through a series of linkages and moveable components. As a result, any unavoidable play or clearances in the linkages accumulates in the bottom latch once the push pad is released, and the bottom latch will drag on the floor and must be adjusted independently by manipulation of the bottom rod. This is a serious drawback, in that field installation people usually do not have the expertise required to make these adjustments correctly. Since the deadlocking feature in the latches is dependent upon the air gap between the bottom of the door and the strike lip located in the floor, it becomes almost critical. The gap can vary between ¼" and ¾" and dictates different latch bolt extensions into the floor strikes. Since there are commonly only one to three deadlocking positions to allow adjustment for varying door bottom gaps and tolerance stack-up in the linkages, the quality of the deadlocking function is questionable.

The method of latch retraction is an objectionable feature which also relates to both rim lock and vertical rod lock systems. Latch retraction in both systems requires depression of the push pad by at least ¾ inches in order to provide sufficient motion in the retraction mechanism of the device to fully retract the latch bolt. When the push pad is not depressed, it projects outwardly from the door, interferes with passage of equipment through the doorways and even lends itself to damage. In addition to its undesirable aesthetics, the large amount of motion for bolt retraction is accompanied by a proportionately large amount of noise and wear of the assembly.

The foregoing illustrates limitations known to exist in present push pad operated panic exit devices. Thus, it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a push pad releasable exit device with continuous deadlocking for mounting near a door edge for engaging a lock strike is provided, including a housing having first and second sidewalls upon which are mounted two end walls and an internal wall parallel to the end walls, each of the end walls and the internal wall having a hole, the holes being aligned on a common axis, the first sidewall having a wedge stop projecting inwardly therefrom toward the axis of the holes in the end walls and the internal wall; a tapered latch bolt mounted on a cylindrical shaft, the shaft extending through the holes and having biasing means for urging the latch bolt toward the lock strike; a wedge plate having a hole providing clearance around the shaft and aligned with the holes in the end walls, having a tab pivotally resting in a slot of the second wall, and having a corner distal from the tab resting against the wedge stop when the door is in an open position; means for sensing when the door is in a closed position and for flipping the wedge plate away from the wedge stop to grip the shaft and to thereby deadlock the latch bolt; and means for releasing the shaft in response to minimal deflection of the push pad to permit the latch bolt to ride over the lock strike.

The foregoing and other aspects of the invention will become apparent from the following detailed descriptions when considered in conjunction with the accompanying drawings.

DETAILED DESCRIPTION

The invention employs a different operating principal from that described in the BACKGROUND OF THE INVENTION. Previous designs relied on a latch bolt that rotated to clear a fixed strike on closing, and reguired sufficient travel of the push pad to retract the bolt by means of a system of levers, axles, and rods. In the invention, a spring-loaded linear sliding latch bolt is profiled to "bump" over the door strike. Further, the push pad is not used to retract the latch bolt but to release a deadlocking mechanism which prevents opening of the door until the push pad is depressed. The motion of a person going through a door with the push pad depressed is sufficient to propel the latch bolt over the strike, thereby eliminating the need to have the push pad retract the bolt. This fact permits using the push pad only to trigger the disengagement of a pawl, a sear, or other escapement type of device. Such an arrangement requires only a bare minimum of motion of the push pad.

Figure 1:
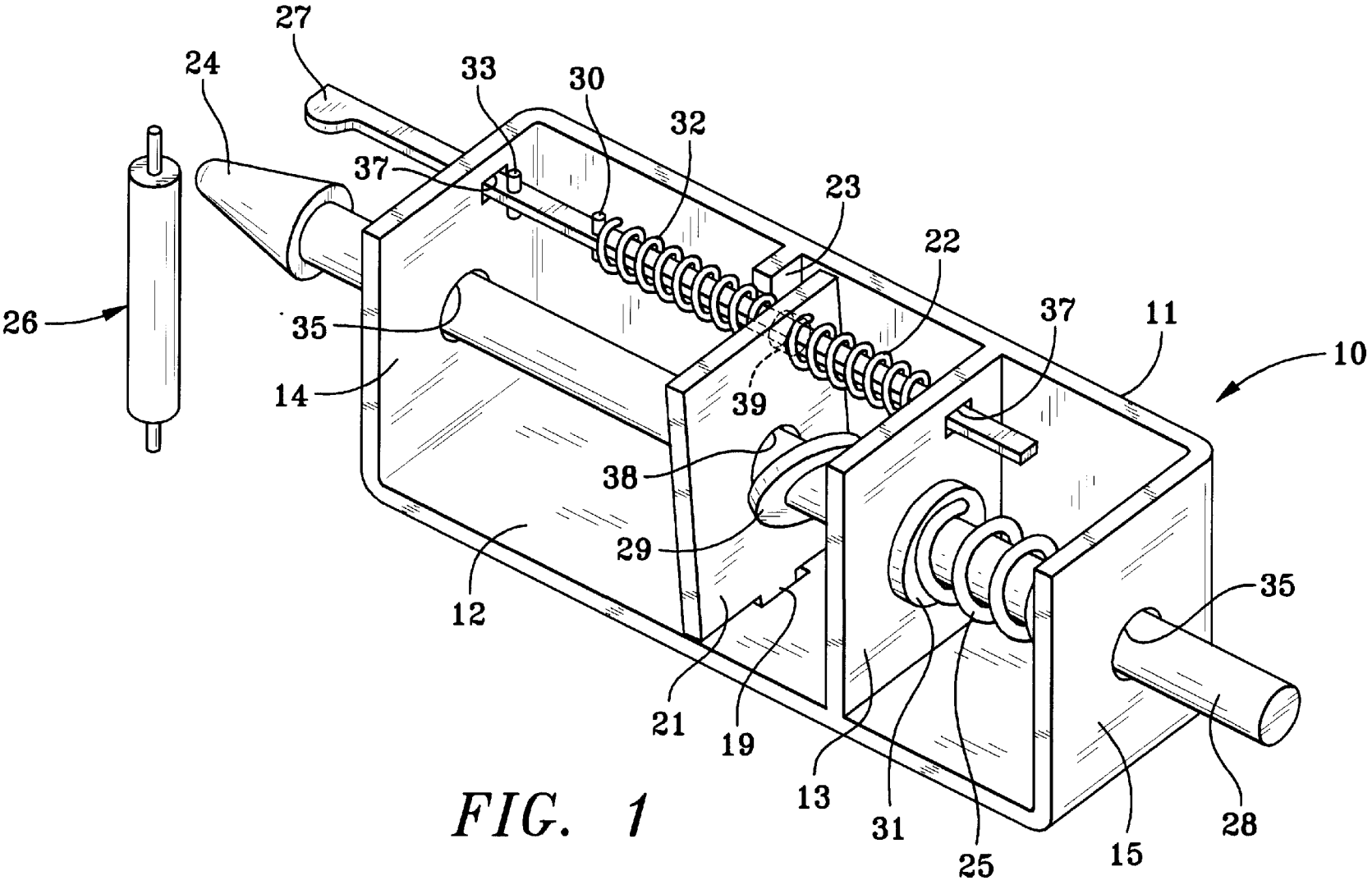
FIG. 1 is a perspective schematic view illustrating a rim latching embodiment of the push pad releasable exit device of the invention in the "door open" position.
Figure 2A:
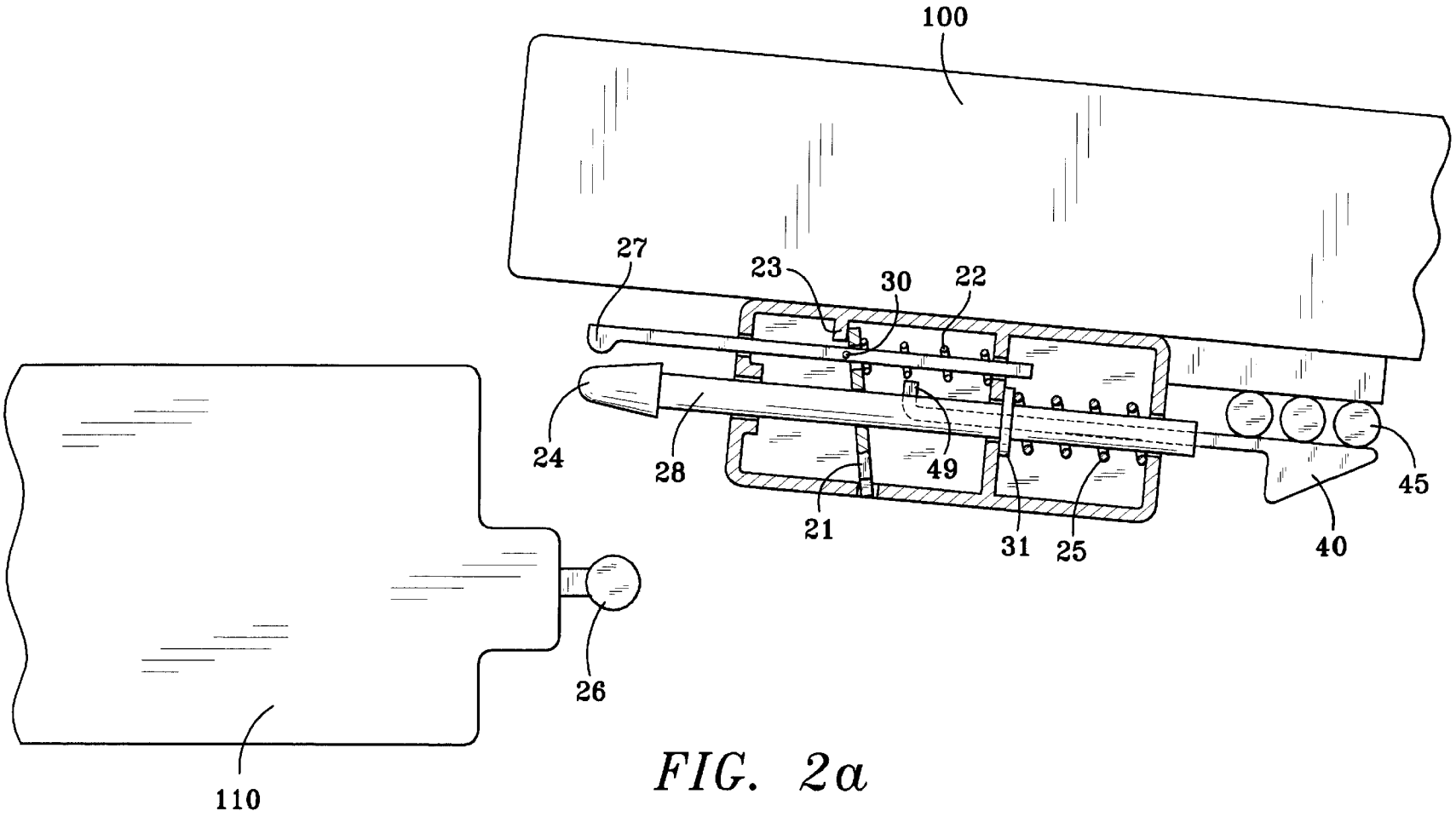
FIGS. 2*a* and 2*b* show another embodiment of the rim latching exit device in "door open" and "door closed" positions, respectively.
Figure 2B:
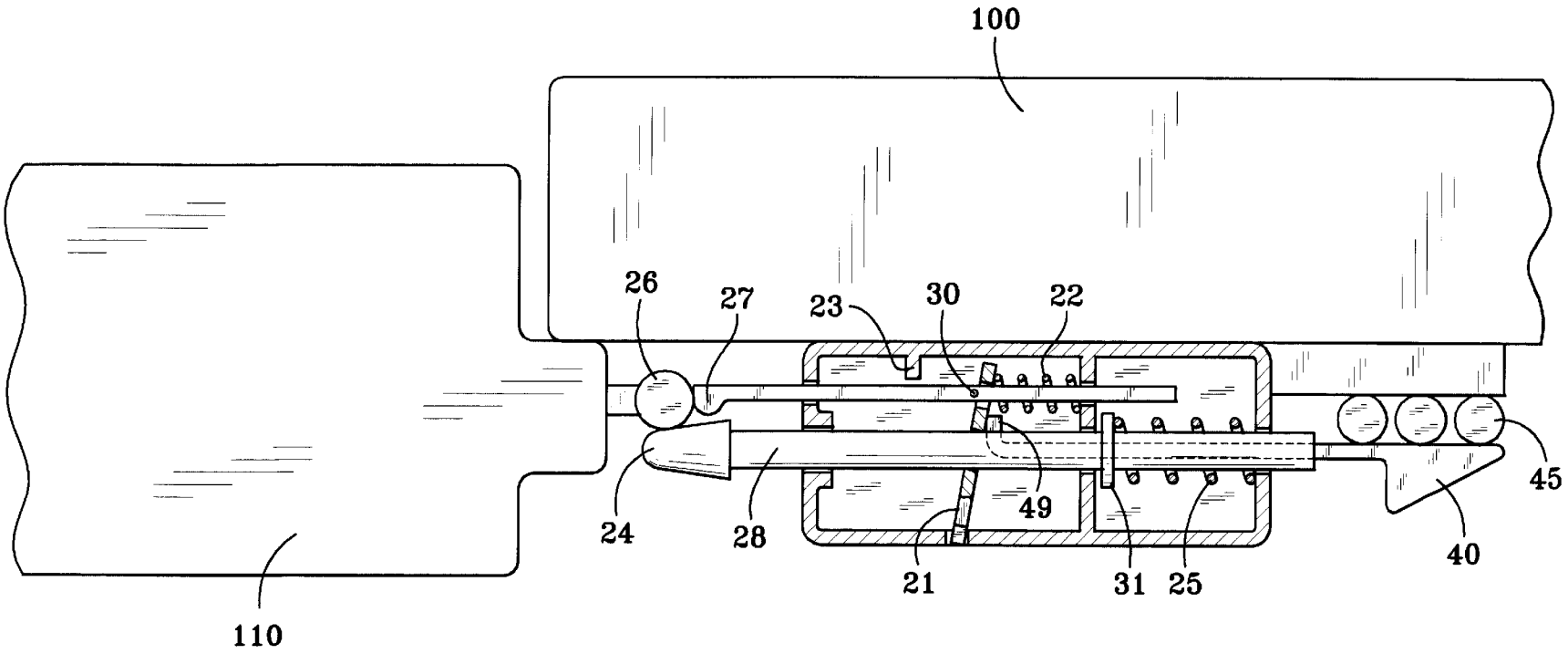

FIGS. 1, 2*a*, and 2*b* show a rim lock embodiment of the invention with a few minor variations in the deadlocking release mechanism. The push pad trigger release exit device 10 consists of a housing which has a first sidewall 11, a second sidewall 12, two end walls 14, 15, an internal wall 13, and a wedge stop 23 projecting inwardly from the first sidewall. The end walls 14, 15 and the internal wall 13 have holes 35*e* aligned on a common axis, in which a cylindrical shaft 28 is slidably disposed. Shaft 28 has a tapered latch bolt 24 on its outer end, a fixed angled swash plate 29 between end wall 14 and internal wall 13, and a fixed spring rest 31 between internal wall 11 and end wall 15. A wedge plate 21, which has a tab 19 pivotally placed in a groove in the second sidewall 12, is disposed between internal wall 13 and wedge stop 23 and also has a hole 38 providing a loose fit on shaft 28 and aligned on the common axis with holes 35. There is also a hole 39 in a corner of wedge plate 21 nearest to wedge stop 23. Hole 39 is aligned with other holes 37 in end wall 14 and internal wall 13.

An auxiliary bolt 27 extends through holes 37 and 39 and has a slight clearance past the edge of wedge stop 23 limited by impingement of stop pin 33 against end wall 14 so the bolt 27 is free to reciprocate in the holes 37 and 39. The auxiliary bolt 27 has a projection 30 which limits its reciprocation with respect to wedge plate 21, thereby allowing wedge plate 21 to be flipped about tab 19 to deadlock shaft 28 and its attached tapered bolt 24 when the door is closed and auxiliary bolt 27 rests on roller strike 26. Spring 22 is compressed by this motion of wedge plate 21 and stores the energy needed to release the shaft 28 from deadlocking when triggered by pressing on the push pad. This is best seen in FIGS. 2*a* and 2*b*, in which embodiments the first and second sidewalls are opposite each other in the housing rather than adjacent.

In operations referring to FIGS. 1, 2*a*, and 2*b*, the wedge 21 is biased by spring 22 so that it leans against wedge stop 23 when the door 100 is open. In this positions the hole 38 of the wedge has littler if any, contact with shaft 28, and the shaft is biased to an extended position by spring 25 pushing between end wall 15 and spring rest 31. As the door 100 is closed, the latch bolt 24 hits the roller strike 26 and, because of its tapered profile, bumps over the strike by momentarily compressing spring 25 and then returns to its extended positions latched against strike 26.

When the door 100 is closed, the auxiliary bolt 27 is pushed in and rests against strike 26. As the auxiliary bolt is pushed in, a projection 30 on bolt 27 engages spring 32 which pushes against wedge 21 and flips the wedge away from wedge stop 23 so that the edges of hole 38 engage shaft 28 and dead lock it in its extended position. Any attempt to push the latch bolt in without first depressing the push pad will cause the edges of hole 38 in wedge plate 21 to grip more tightly on shaft 28. This feature can be considered infinite or continuous deadlocking; because the wedge 21 can grip shaft 28 at any position along its length, as long as the wedge 21 is flipped away from the wedge stop 23 by the auxiliary bolt 27 resting on strike 26.

To open the door, it only requires a push against the push pad to trigger release the deadlock feature. In the embodiment of FIG. 1, depression of the push pad causes rotation of shaft 28 by a few degrees. Swash plate 29 is fixed to shaft 28 at an angle substantially the same as that at which wedge plate 21 engages the shaft so that, the slightest rotation of the shaft causes the swash plate 29 to push against wedge 21 and releases the grip of wedge 21 on shaft 28 to allow the shaft to retract and bump over strike 26 as the door opens. Latch bolt 24 retraction is powered by the push force exerted on the push pad and transmitted to the door. This force is the amount normally required to open a door. Neither the push pad nor the mechanism for converting linear motion of the pad into rotary motion of the shaft are shown; because they are common combinations of levers, gears, rods, springs, wedges, and bearings which are found in innumerable devices and are well known in the arts A linear-to-linear release is shown in FIG. 2*b* in which a push on the push pad causes a low friction push against an inclined face of a wedge shaped end of a release rod 40 which rides on bearings 45. Rod 40 moves leftward in the Fig. to force dog 49 against wedge 21 to release deadlocking of the shaft 28 and latch bolt 24.

Figure 3:
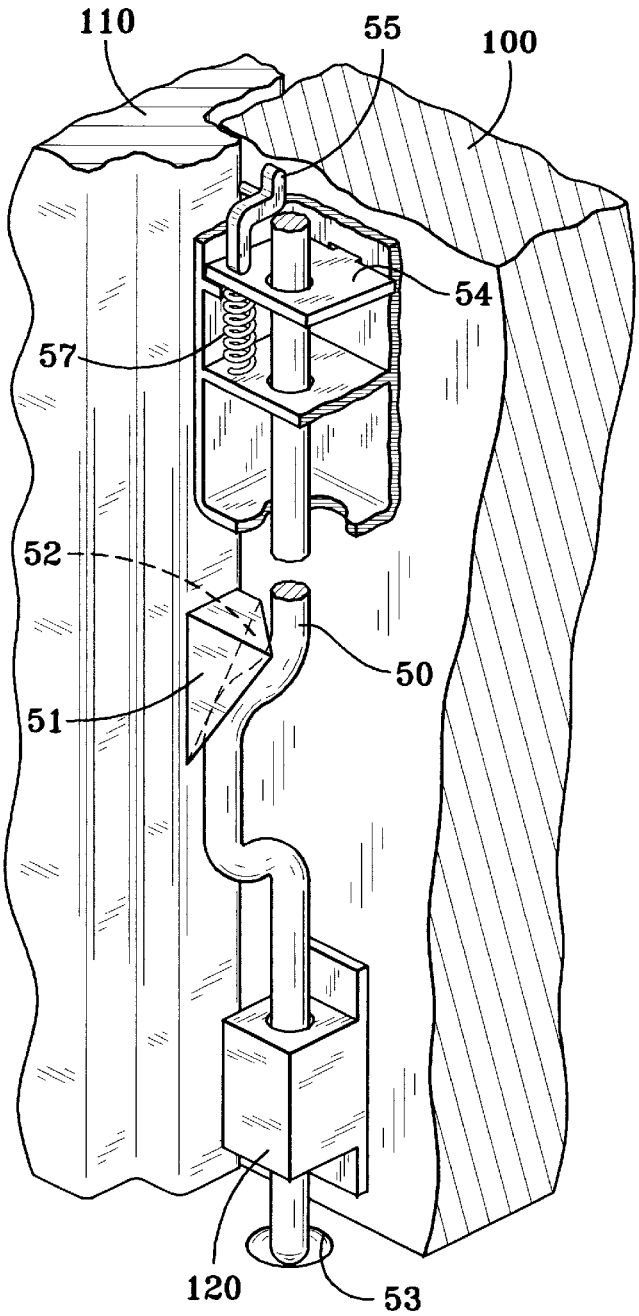
FIGS. 3*a*, and 3*b* show a vertical rod locking embodiment of the invention and two additional floor strike options.
Figure 3A:
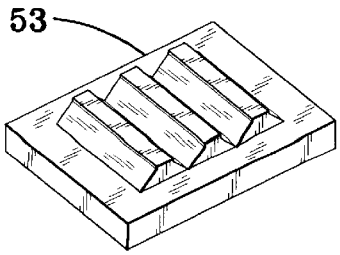
Figure 3B:
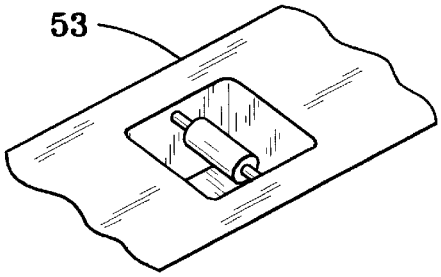

The vertical rod latching system shown in FIG. 3 can also benefit from use of the wedge plate design described. The door 100 is shown in the closed position against door frame 110 with its bottom rod 50 engaged with floor strike 53. A downward facing deflector 51 is mounted on the door frame 110 in position to engage a corner of an offset portion of rod 50 as the door 100 closes. The sloping face 52 of deflector 51 forces rod 50 downward into engagement with strike 53. Attempts to open the door 100 by pushing or pulling on the door without first depressing the push pad will fail. The bottom rod cannot move away from strike 53 because of the action of wedge plate 54, and efforts to lift the rod only cause the wedge plate 54 to bite harder on the rod. When the push pad is pressed, pin 55 displaces wedge plate 54 to release the deadlocking of rod 50. Note that spring 57 always biases wedge plate 54 upward so that it always is in position to grip rod 50 to prevent upward movement thereof. Rod 50 is also upwardly biased inside housing 120. Except for direction, the top rod of a vertical rod latching system operates identically to the bottom rod described above. One major advantage of the continuous deadlocking of the present invention is that it permits such locking in a virtually infinite number of locations on the rod. This allows for firm locking in spite of changes in bottom door gap caused by settling or installation defects. It also allows use of the system with a variety of floor strike options, for example the hollow cylindrical strike pocket of FIG. 3, the elevated toothed strike of FIG. 3*a*, and the recessed roller strike pocket of FIG. 3*b*.

Figure 4:
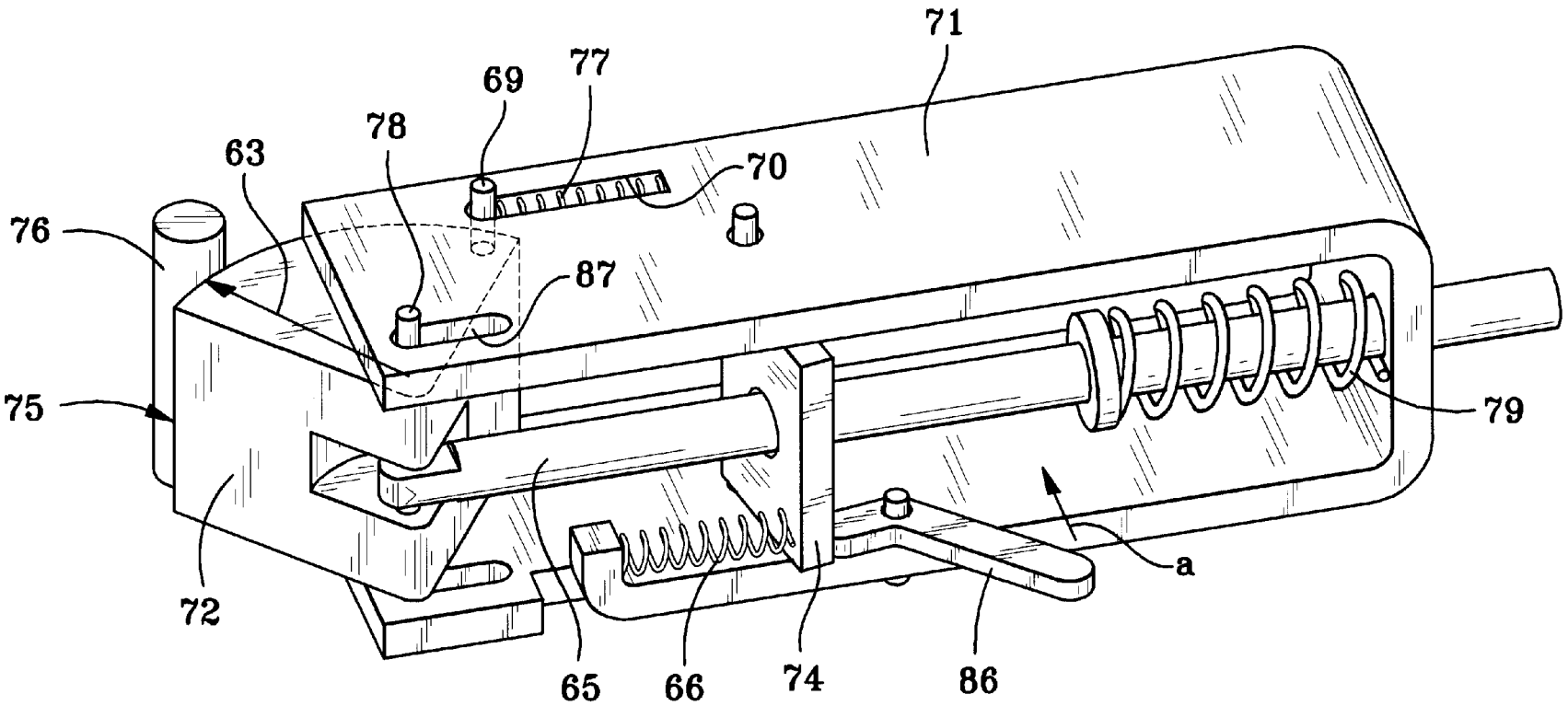
FIG. 4 shows another embodiment of the invention for use with a rotating latch bolt in a rim latching application.

A variation of the wedge plate concept is possible for use with a rotating latch bolt 75. FIG. 4 shows such a rotating latch bolts Starting from the open position, as the door closes, the latch bolt 75 is biased outwardly toward the strike 76 by compression springs 77 acting upon pin 69. Latch bolt 75 can rotate about axle 78 and is stopped by pin 69 in the fully extended position by the termination of slot 70 in the housing 71. As the door closest the face 72 of the latch bolt 75 contacts the strike 76 and rotates clockwise into the housing 71 about axle 78 and compresses springs 77 in the process. Once the latch bolt clears the strike 76, the compression springs 77 return the latch bolt 75 to its fully extended position as seen in FIG. 4.

Deadlocking of the rotating latch bolt is accomplished without use of an auxiliary bolt. The radius 63 of the latch bolt 75 is such that its center coincides with the axle 78 and any force applied to open the door without releasing the wedge 74 will fail because of the alignment between the axle 78 and the strike 76 on the radius 63. This eliminates any tendency for the latch bolt to rotate to accommodate the applied force. In order to open the doors the wedge 74, which is forced against shaft 65 by spring 66, must be displaced sufficiently leftward in the figure to release its grip on shaft 65. This is done by trip lever 86 which abuts wedge plate 74 in its locking position and which also abuts the push pad before it is pressed. The shaft 65 is then free to move axially away from strike 76. As shaft 65 moves through wedge 74 axle 78 is free to travel with the shaft 65 along slot 87 in the housing 71. This allows the latch bolt 75 to pivot about pin 69 and to pass the strike 76 to allow opening the door. Once the latch bolt has cleared the strike 76, compression spring 79 returns the shaft 65 and the axle 78 back to the position in which the latch bolt is fully extended. Spring 66 will return the wedge 74 to its locking position upon release of the push pad.

What is claimed is:

1. A push pad releasable exit device with continuous deadlocking for mounting near a door edge for engaging a lock strike, comprising:

a first housing having first and second sidewalls upon which are fixedly mounted at least one end wall, said at least one end wall having a circular hole therethrough;

a latch bolt having a cylindrical shaft extending therefrom, said shaft extending through said at least one end wall circular hole and having means for urging said latch bolt into an extended position;

a wedge plate in the first housing having a hole providing clearance around said shaft and aligned with said at least one end wall circular hole, and having a tab pivotally resting in an aperture in said second wall;

means for biasing said wedge plate to grip said shaft and deadlock said latch bolt, the means for biasing said wedge plate applying a force to the wedge plate offset from the wedge plate hole;

means for releasing said shaft in response to minimal deflection of said push pad to permit said latch bolt to ride over said lock strike.

2. The push pad releasable exit device according to claim 1, wherein the first sidewall has a wedge stop projecting inwardly therefrom toward the axis of the shaft, the wedge plate having a corner distal from the tab resting against the wedge stop when the door is in an open position.

3. The push pad releasable exit device according to claim 2, wherein the wedge plate has a corner distal from the tab resting against the wedge stop when said door is in an open position.

4. The push pad releasable exit device according to claim 1, wherein the number of end walls is two, the first housing has an internal wall parallel to the end walls, the internal wall having a circular hole, the end wall holes and the internal wall hole being aligned on a common axis, the first sidewall having a wedge stop projecting inwardly therefrom toward the axis of the holes in the end walls and the internal wall, the shaft extending through the holes and through a second housing in which the latch bolt is adapted to be biased away from the lock strike, the wedge plate having a corner distal from the tab resting against the wedge stop when the door is in an open position.

5. The push pad releasable exit according to claim 4, wherein the means for urging the latch bolt to an extended position comprises an elbow in the latch bolt shaft projecting perpendicularly outward from the door face to engage with an inclined face of a deflector mounted on the door frame, the deflector guiding the latch bolt shaft to extend into engagement with the strike.

6. The push pad releasable exit device according to claim 1, wherein the number of end walls is two, the first housing having an internal wall parallel to the end walls, the internal wall having a hole, the end wall holes and the internal wall hole being aligned on a common axis, the first sidewall having a wedge stop projecting inwardly therefrom toward the axis of the holes in the end walls and the internal wall, the latch bolt being tapered, the shaft extending through the holes, the wedge plate having a corner distal from the tab resting against the wedge stop when the door is in an open position, and further comprising: means for sensing when said door is in a closed position and for flipping the wedge plate away from the wedge stop to grip the shaft and to thereby deadlock the latch bolt.

7. The push pad releasable exit device according to claim 6, wherein the means for urging the latch bolt toward the lock strike comprises a spring member acting between an end wall and a spring rest on the cylindrical shaft.

8. The push pad releasable exit device according to claim 6, wherein the means for sensing when the door is in a closed position and for flipping the wedge plate away from the wedge stop comprises an auxiliary bolt which rests against the door lock strike and has means for pushing the wedge plate away from the door edge to deadlock the bolt when the door is closed, and means for returning the wedge plate to rest against the wedge stop to release the deadlocking when the door is open or the push pad is depressed.

9. The push pad releasable exit device according to claim 8, wherein the means for returning the wedge plate to rest against the wedge stop when the push pad is depressed comprises a biasing spring which causes the wedge plate to rest against the wedge stop when not engaged in deadlocking the bolt.

10. The push pad releasable exit device according to claim 8, wherein the means for returning the wedge plate to rest against the wedge stop when the push pad is depressed comprises a linear-release bearing-mounted rod having an end with a wedge-shape, engaged with the push pad such that the rod moves sidewards when the push pad is depressed, and an end with lug means for displacing the wedge plate to release the shaft and to allow the wedge plate to flip to a resting position against the wedge stop driven by a wedge release spring.

11. The push pad releasable exit device according to claim 6, wherein the means for releasing the shaft in response to minimal deflection of the push pad comprises a swash plate fixedly mounted on the cylindrical shaft adjacent the wedge plate in the deadlocking position such that only a minimal rotation of the cylindrical shaft is needed to release the deadlocked shaft from the wedge; and means for converting linear push pad motion to rotary shaft motion.

12. The push pad releasable exit device according to claim 1, wherein the housing has an open end opposite the at least one end wall, the first sidewall has a wedge spring seat projecting inwardly therefrom, the latch bolt is a rolling latch bolt extending longitudinally from between the sidewalls and having a substantially triangular cross section, one side of which describing approximately a 60° arc, in a plan view along the door edge, two pivot pins projecting through two corners of the bolt and biasedly journaled in slots in the sidewalls, one pivot pin providing pivotal mounting for the rolling bolt latch on the cylindrical shaft, the shaft joining to the latch bolt pivot at the axis of the latch bolt radially inward from a contact point with the lock strike on the arcuate surface of the latch bolt, the wedge plate having a corner distal from the pivotal support resting against the wedge spring.

13. The push pad releasable exit device according to claim 11, wherein the means for releasing the shaft in response to minimal deflection of the push pad to permit the latch bolt to ride over the lock strike comprises a trip lever for breaking the grip of the wedge plate on the shaft.

* * * * *